United States Patent [19]

Kosik

[11] 4,163,593

[45] Aug. 7, 1979

[54] SEPARABLE HOSE COUPLING

[75] Inventor: John Kosik, Stamford, Conn.

[73] Assignee: Consolidated Foods Corporation, Old Greenwich, Conn.

[21] Appl. No.: 835,545

[22] Filed: Sep. 22, 1977

[51] Int. Cl.[2] ..... H01R 3/04

[52] U.S. Cl. ..... 339/15; 339/16 R

[58] Field of Search ..... 339/15, 16

[56] References Cited

U.S. PATENT DOCUMENTS 3,387,319 6/1968 Ferraris et al. ..... 339/16 R X 3,434,092 3/1969 Brown et al. ..... 339/16 R

*Primary Examiner*—Roy Lake

*Assistant Examiner*—DeWalden W. Jones

*Attorney, Agent, or Firm*—William S. Henry

[57] ABSTRACT

The present invention relates to a separable coupling for connecting a suction hose to a vacuum cleaner and at the same time establishing an electric circuit between conductors in the hose and in the cleaner and involves means for preventing short circuits in the coupling even though the latter may suffer a mechanical damage.

1 Claim, 6 Drawing Figures

SEPARABLE HOSE COUPLING

BACKGROUND

The invention is an improvement over the couplng shown in U.S. Pat. No. 3,434,092 issued Mar. 18, 1969 to R. J. Brown et al. In a vacuum cleaner of this type, the hose serves not only to convey air but also to pull the cleaner over the floor, and the mechanical force required is transmitted from the hose through the coupling to the cleaner. The hose is connected to the coupling by being clamped between a metal sleeve and a plastic part, the latter carrying electric contacts which protrude with clearance through apertures in an outer metal shell which carries latches engaging abutments on the cleaner. Should the aforesaid mechanical force cause the connection between the hose and the coupling to loosen, it could result in the plastic part and the outer metal shell shifting relative to each other, thereby causing the electric contacts to touch the edges of the apertures in the metal shell to cause a short circuit.

SUMMARY

The present invention provides means for preventing shifting of the parts of the coupling relative to each other, and thus preventing a short circuit, even if the bond between the hose and coupling has failed under the stress of the mechanical force transmitted from the hose for moving the cleaner, as will be apparent from the following detailed description, illustrated in the accompanying drawings, of which:

Figure 1:
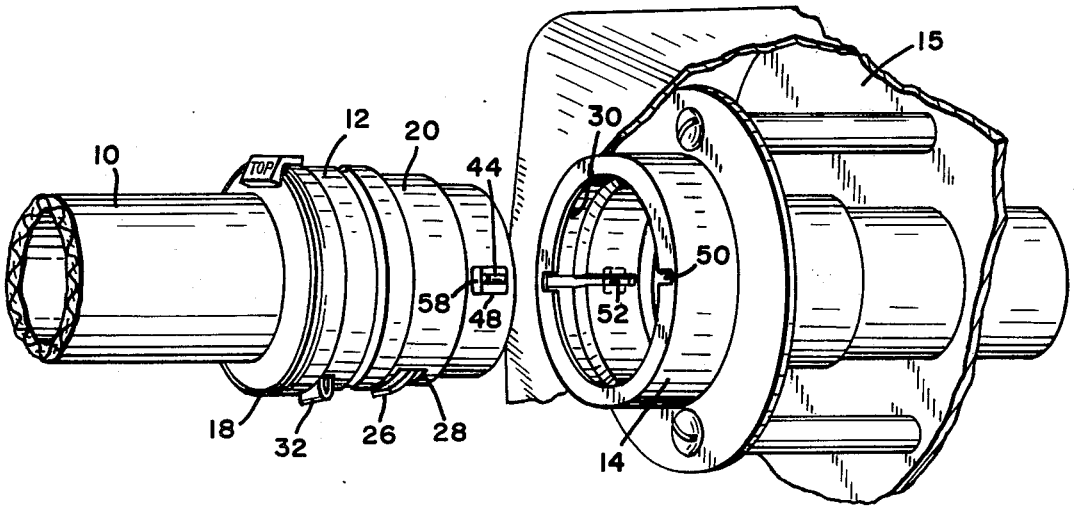
FIG. 1 is a perspective view of a couplng embodying my invention, the two elements of the coupling being shown in separated positon.

Referring to the drawings, reference character 10 designates a flexible suction hose for conveying air from a suction nozzle to a vacuum cleaner unit. Secured to an end of said hose is the male element 12 of a separable connector, the female element 14 of which is mounted on said unit, only a part 15 of which is shown.

Male element 12 comprises an inner sleeve 16 of insulating material formed with an outwardly extending flange 18 at one end, and an outer metallic sleeve 20 with one end abutting against flange 18. These sleeves are spaced apart by radially extending projections 22 on inner sleeve 16, so as to provide an annular space 24 therebetween. Disposed within this space is a pair of diametrically opposed latch members 25, one of which is shown particularly in FIG. 2. Each latch member has a projection 26 extending outwardly through an opening 28 in outer sleeve 20 which is engageable behind an annular lip 30 of female element 14 when the two elements are coupled together. Projection 26 may be retracted, in order to separate the coupling elements 12 and 14, by applying manual pressure to a button 32 on the latch member which extends through an opening 34 in the outer sleeve.

Figure 2:
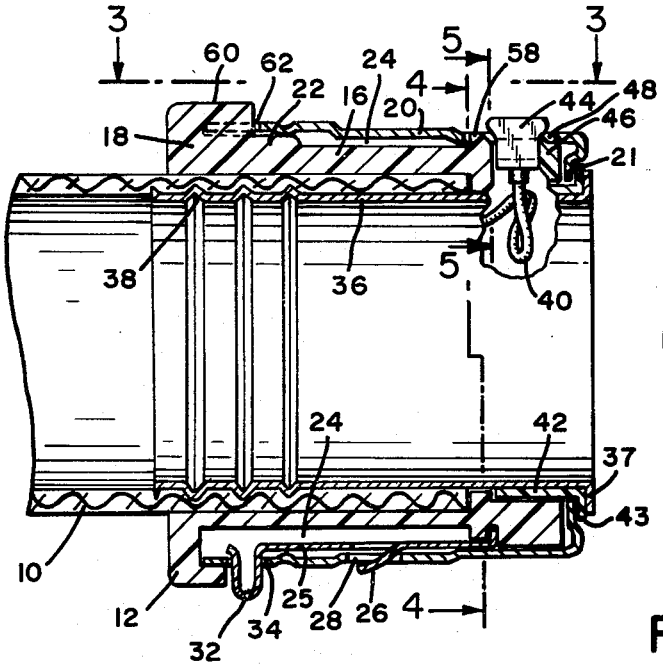
FIG. 2 is a cross-sectional view of one element of the couplng shown in FIG. 1 and is taken on the line 2—2 of FIG. 4.
Figure 4:
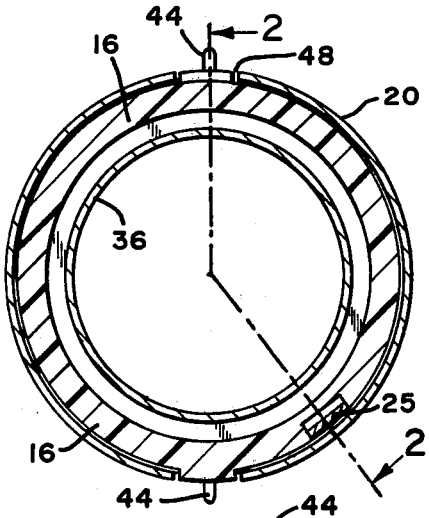
FIG. 4 is a cross-sectional view taken on the line 4—4 of FIG. 2.
Figure 5:
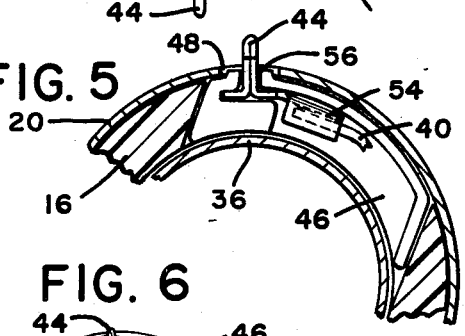
FIG. 5 is a cross-sectional view taken on the line 5—5 of FIG. 2.

As shown particularly in FIG. 2, hose 10 is secured to coupling element 12 by being clamped between the inner surface of insulating sleeve 16 and a metal tubular insert 36 which, after having been inserted in the hose, is expanded by a suitable tool to form the ribs 38. The outer end of insert 36 is formed with radially outwardly extending flange 37.

A pair of insulated electric conductors 40, one of which is shown in the broken-away section in FIG. 2, is in well-known manner built into the wall of hose 10 and serves to conduct electricity to an electric motor in the suction nozzle which is connected to the other end of the hose. Conductors 40 emerge from the end of hose 10 into a space beyond the end of inner sleeve 16. A tube of insulating material 42 surrounds the portion of insert 36 which extends into this space. Tube 42 has a flange 43 bearing against flange 37 on insert 36. Outer sleeve 20 has an inwardly extending flange 21 which abuts the inner face of flange 43. Two electrical contacts 44 are mounted on inserts 46 within this space and extend radially outwardly through apertures 48 in outer sleeve 20. When the two elements of the coupling are connected together, these contacts are aligned with axial grooves 50 in the female element 14 and pass through these grooves as the elements are connected, and by the time latch projections 26 have engaged behind lip 30, contacts 44 have made contact with electrical contacts 52 in female element 14.

Each contact 44 has an extension 54 to which is connected one of the conductors 40. contact 44 is secured to insert 46 by being slid into a slot 56 in the insert, which slot is closed at the end adjacent flanges 37 and 43 but is open at the other end to permit introduction of the contact into the slot.

Figure 3:
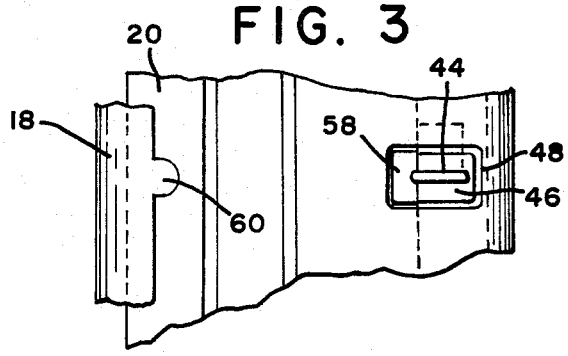
FIG. 3 is a top view of a portion of said element, looking in the direction of the arrows 3—3 in FIG. 2.
Figure 6:
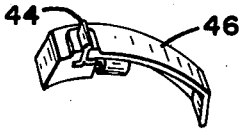
FIG. 6 is a perspective view on a reduced scale of a part of the structure shown particularly in FIG. 5.

Sleeve 16 of insulating material is provided with a pair of projections 58, one of which extends through each aperture 48 between the left end of the aperture as viewed in FIGS. 1,2 and 3, and the contact 44, so as to interpose an insulation barrier between the contact and the metal of sleeve 20 at the left end of aperture 48. As shown in FIGS. 2 and 3, flange 18 on inner sleeve 16 is formed with a projection 60 which is received in a recess 62 in outer sleeve 20 so as to prevent relative rotation between the two sleeves, which, were it to occur, would permit the contacts 44 to touch an edge of the aperture 48.

Should the clamping of the hose 10 between inner sleeve 16 and tubular insert 36 eventually be loosened by the forces transmitted when the vacuum cleaner unit 15 is pulled around the floor by the hose, it could permit the sleeve 16 to move longitudinally relative to insert 36, and if this movement resulted in sleeve 16 being displaced to the left, as viewed in FIG. 2, relative to tubular insert 36, it would also permit contacts 44 to move to the left sufficiently to touch the left edge of apertures 48 in sleeve 20 if it were not for the insulation barrier provided by projections 58.

If sleeve 20 touched both contacts 44 while they were connected to the 120-volt source through contacts 52, it of course could result in a short circuit, but if only one contact touched sleeve 20, the entire metal body of the vacuum cleaner unit 15 might become a source of shock to anyone touching it.

While there has been shown one more or less specific embodiment of my invention, it is to be understood that this has been done for purposes of illustration only and that the scope of my invention is not to be limited thereby, but is to be determined by the appended claim.

I claim:

1. In a separable connector for connecting a hose to a vacuum cleaner and for establishing an electric circuit between the hose and the cleaner, an inner sleeve of electrical insulating material, means for securing said sleeve to the outer surface at one end of the hose, said sleeve being formed with an outwardly extending flange at one end thereof, an outer metallic sleeve around said inner sleeve with one end thereof abutting against said flange, radial projections on one of said sleeves for spacing said sleeves apart to provide an annular space therebetween, manually retractable latch members disposed in said space and projecting through openings in said outer sleeve for releasably engaging surfaces on said vacuum cleaner, a pair of electric contacts carried by said inner sleeve and extending in spaced relation through apertures in said outer metallic sleeve, lugs of insulating material extending from said inner sleeve into said apertures at the ends of the latter adjacent to said flange for providing an insulation barrier between said contacts and the metal of said outer sleeve at said ends of the apertures and an axially extending projection from said flange engaging a recess in the adjacent end of said outer sleeve to prevent relative rotation between the two sleeves, whereby said contacts are prevented from touching the edges of said apertues in the outer metallic sleeve.

* * * * *